US009273867B2

(12) United States Patent
Buzinski et al.

(10) Patent No.: US 9,273,867 B2
(45) Date of Patent: Mar. 1, 2016

(54) RETRACTABLE IGNITION SYSTEM

(71) Applicant: Air Products and Chemicals, Inc., Allentown, PA (US)

(72) Inventors: Michael David Buzinski, Slatington, PA (US); Shailesh Pradeep Gangoli, Easton, PA (US); William Otto Litrenta, Schnecksville, PA (US); Reed Jacob Hendershot, Orefield, PA (US); Larry Saul Zelson, Lansdale, PA (US)

(73) Assignee: AIR PRODUCTS AND CHEMICALS, INC., Allentown, PA (US)

( * ) Notice: Subject to any disclaimer, the term of this patent is extended or adjusted under 35 U.S.C. 154(b) by 557 days.

(21) Appl. No.: 13/758,231

(22) Filed: Feb. 4, 2013

(65) Prior Publication Data

US 2014/0220499 A1 Aug. 7, 2014

(51) Int. Cl.
*F23Q 13/00* (2006.01)
*F23Q 3/00* (2006.01)

(52) U.S. Cl.
CPC ..... *F23Q 3/006* (2013.01); *F23D 2207/00* (2013.01)

(58) Field of Classification Search
CPC ..... F23D 2207/00
USPC ..... 431/264, 263, 193
See application file for complete search history.

(56) References Cited

U.S. PATENT DOCUMENTS

| | | | | |
|---|---|---|---|---|
| 2,651,298 | A | 9/1953 | Brinson et al. | |
| 3,548,592 | A * | 12/1970 | Hopkins | 60/39.827 |
| 3,802,828 | A * | 4/1974 | Mercer et al. | 431/255 |
| 4,613,302 | A * | 9/1986 | Oliver | 431/263 |
| 5,622,672 | A * | 4/1997 | Swick et al. | 266/48 |
| 6,438,940 | B1 * | 8/2002 | Vacek et al. | 60/204 |
| 7,551,420 | B2 | 6/2009 | Cerqueira et al. | |
| 2006/0279900 | A1 | 12/2006 | Cerqueira et al. | |
| 2007/0091542 | A1 | 4/2007 | Takada | |
| 2012/0279195 | A1 * | 11/2012 | Sutcu et al. | 60/39.821 |

FOREIGN PATENT DOCUMENTS

| | | | |
|---|---|---|---|
| CN | 2104994 | U | 5/1992 |
| CN | 2186866 | Y | 1/1995 |
| CN | 201310921 | Y | 9/2009 |
| CN | 102607056 | A | 7/2012 |
| GB | 1092371 | | 11/1967 |

* cited by examiner

*Primary Examiner* — Avinash Savani
(74) *Attorney, Agent, or Firm* — Larry S. Zelson

(57) ABSTRACT

An integrated retractable burner ignition system including a burner having an outlet face and a flow passage including a front end substantially coincident with the outlet face of the burner and a gas inlet positioned rearward from the front end of the flow passage, an igniter including a high voltage electrode surrounded by an insulator and extending beyond the insulator to form a tip end of the igniter, the igniter being mounted slidably within the flow passage, an actuator connected to a rear portion of the igniter and configured to advance and retract the igniter within the flow passage, and a slidable seal between the igniter and the flow passage, the seal being positioned rearward of the gas inlet of the flow passage and frontward of the rear portion of the igniter.

27 Claims, 5 Drawing Sheets

RETRACTABLE IGNITION SYSTEM

BACKGROUND

This application relates to a retractable ignition system for a burner, an integrated burner with retractable spark ignition system, and methods for igniting a burner using a retractable ignition system.

Many industrial processes, including in the metals industries, use burners that operate for relatively short periods of time and are frequently shut down and re-ignited. In some instances, re-ignition can be required several times a day. Therefore, it is necessary to have an ignition system that is reliable for thousands of ignition cycles, and also able to operate in harsh environments where burners are often used.

A reliable igniter should initiate spark at an appropriate location, i.e., where fuel and oxidizer mix in flammable proportions. Properly locating an igniter is difficult with existing external igniters.

In addition, once the flame is initiated, the ignition system plays no role until the burner is shut down and ignition is required again for restart. However, most existing systems leave the igniter in the furnace during operation of the burner, so that the igniter is exposed to intense radiation from the flame and the furnace, as well as products of incomplete combustion such as soot, which eventually leads to damage of the igniter. Consequently, ignition becomes less reliable and igniters must be maintained and replaced frequently.

SUMMARY

In one embodiment, an integrated retractable burner ignition system is provided including a burner, and igniter, an actuator, and a slidable seal. The burner has an outlet face and a flow passage. The flow passage includes a front end substantially coincident with the outlet face of the burner and a gas inlet positioned rearward from the front end of the flow passage. The igniter includes a high voltage electrode surrounded by an insulator and extending beyond the insulator to form a tip end of the igniter, and is mounted slidably within the flow passage. An actuator is connected to a rear portion of the igniter and configured to advance and retract the igniter within the flow passage. A slidable seal is positioned between the igniter and the flow passage, rearward of the gas inlet of the flow passage and frontward of the rear portion of the igniter.

In one aspect the actuator is a bi-directional pneumatic actuator configured to pneumatically advance and pneumatically retract the igniter.

In another aspect the pneumatic actuator includes a handle connected to the rear portion of the igniter to enable the igniter to be manually advanced and retracted in the absence of a supply of pressurized air.

In another aspect, the seal includes a seal block mounted to an outer surface of the igniter and slidably sealing along an inner surface of the flow passage. Alternatively, the seal includes a seal block mounted to an inner surface of the flow passage and slidably sealing along an outer surface of the igniter.

In another aspect, the flow passage is grounded such that when the igniter is advanced, a gap is created between the high voltage electrode and the front end of the flow passage across which arcing can occur. Alternatively, the igniter further includes a ground electrode at least partially surrounding the insulator, such that a gap is formed between the high voltage electrode and the ground electrode across which arcing can occur.

In another aspect, a guide member is located between an outer surface of the igniter and in inner surface of the flow passage, and between the flow passage gas inlet and front face, for positioning the igniter within the flow passage. The guide member may be affixed to the igniter to advance and retract with the igniter. Alternatively, the guide member may be affixed to the flow passage to remain stationary when the igniter is advanced and retracted.

In another aspect, the actuator is configured to retract the igniter to a retracted position in which the tip end of the igniter is recessed within the flow passage. Alternatively, the actuator is configured to retract the igniter to a retracted position in which the tip end of the igniter is extended frontward beyond the front end of the flow passage.

The flow passage may be either a fuel passage or an oxidant passage.

In one aspect, the system further includes a high voltage transformer configured to provide high voltage to the high voltage electrode upon receipt of a control signal, and the actuator is configured to advance the igniter upon receipt of the control signal and to retract the igniter upon cessation of the control signal. The system may also include a fuel solenoid valve in a fuel conduit supplying fuel to the burner, the fuel solenoid valve being configured to open to enable fuel flow upon receipt of the control signal. In one variation, the flow passage is an oxidant passage, the fuel conduit is configured to provide fuel flow to the flow passage, and the fuel solenoid is further configured to close to disable fuel flow upon cessation of the control signal. In another aspect, the system may also include an oxidant solenoid valve in an oxidant conduit supplying oxidant to the burner, the oxidant solenoid valve being configured to open to enable oxidant flow upon receipt of the control signal In another aspect, the actuator is configured to retract the igniter when a flame detector detects the presence of a flame frontward of the outlet face of the burner.

In another embodiment, a retractable ignition system is described for mounting in a flow passage of a burner having an outlet end. The retractable ignition system includes an igniter including a high voltage electrode surrounded by an insulator and extending beyond the insulator to form a tip end of the igniter, the igniter being mounted slidably within the flow passage of the burner, and an actuator connected to a rear portion of the igniter and configured to pneumatically advance and pneumatically retract the igniter with respect to the outlet end. A slidable seal is positioned between the igniter and the flow passage, the seal being positioned rearward of a gas inlet into the flow passage and frontward of the rear portion of the igniter.

In one aspect, the igniter further includes a ground electrode at least partially surrounding the insulator. The ground electrode may extend beyond the insulator. The ground electrode may includes a cupped member extending radially inward from an edge of the ground electrode toward the high voltage electrode. Alternatively, the ground electrode may include a radially outwardly protruding lip.

In another embodiment, a method is described for igniting a burner having an outlet face and a flow passage. The method includes advancing an igniter located within the flow passage to an advanced position in which a tip end of the igniter is aligned with or frontward of the outlet face of the burner. The igniter includes a high voltage electrode surrounded by an insulator and extending beyond the insulator to form the tip end. The method further includes supplying high voltage to the high voltage electrode while the igniter is in the advanced position, and retracting the igniter in a rearward direction from the advanced position to a retracted position when a retraction condition is met. The igniter is not biased toward either the advanced position or the retracted position.

In one aspect, the method further includes initiating high voltage to the high voltage electrode substantially simultaneously with the step of advancing the igniter. In another aspect, the method further includes ceasing high voltage to the high voltage electrode substantially simultaneously with the step of retracting the igniter.

In one aspect, the retraction condition is expiration of a timer. In another aspect, the retraction condition is detection of a flame frontward of the outlet face of the burner.

In one aspect, the method further includes flowing gas at high momentum through the flow passage, wherein in the retracted position, the tip end of the igniter is frontward of the outlet face of the burner.

In another aspect, the method further includes flowing gas at low momentum through the flow passage, wherein in the retracted position, the tip end of the igniter is within the flow passage.

The various aspects of the system disclosed herein can be used alone or in combinations with each other.

DETAILED DESCRIPTION

Figure 1A:
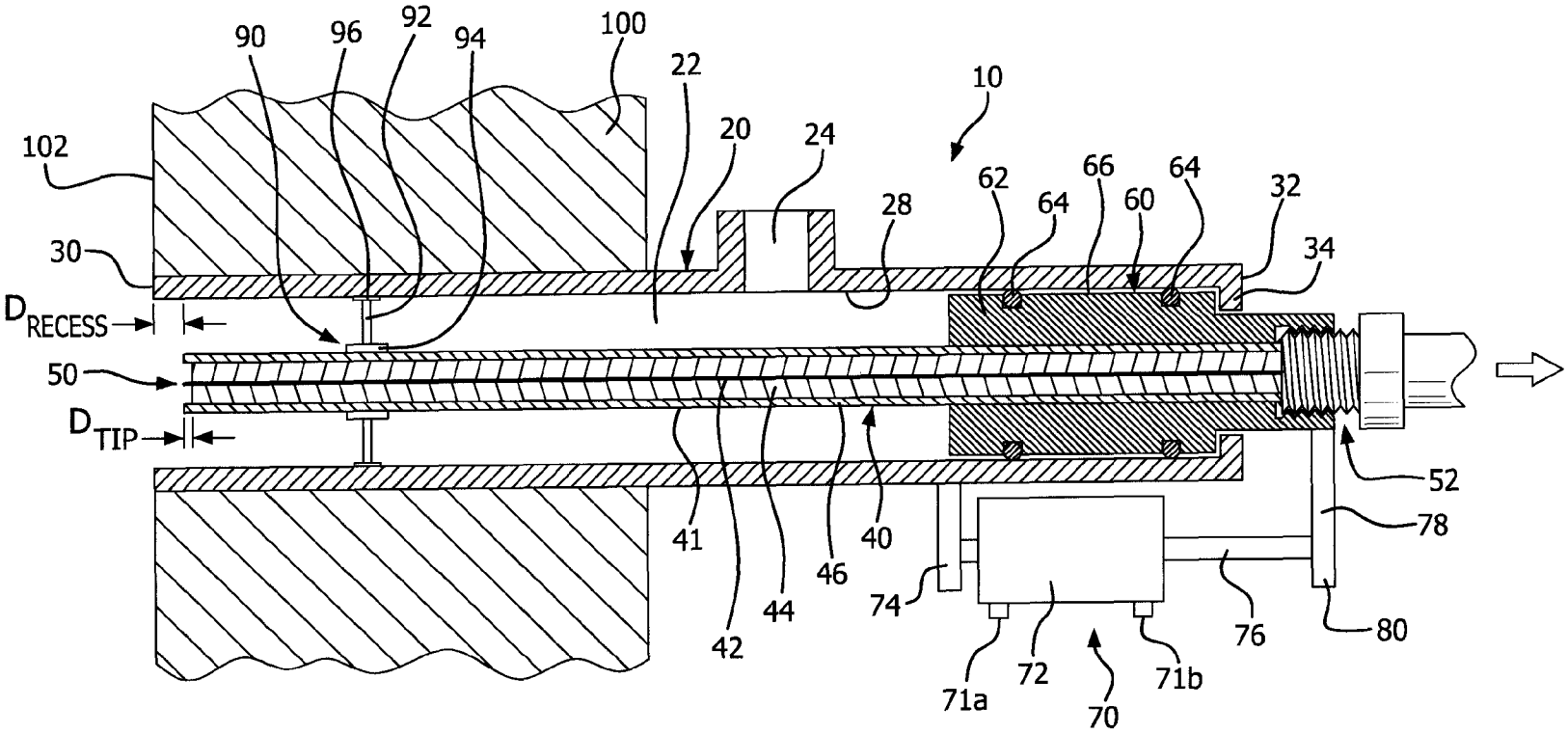
FIG. 1A is a cross-sectional view of an embodiment of a retractable ignition system including a retractable igniter mounted within a flow passage, wherein the igniter is in a retracted position.
Figure 1B:
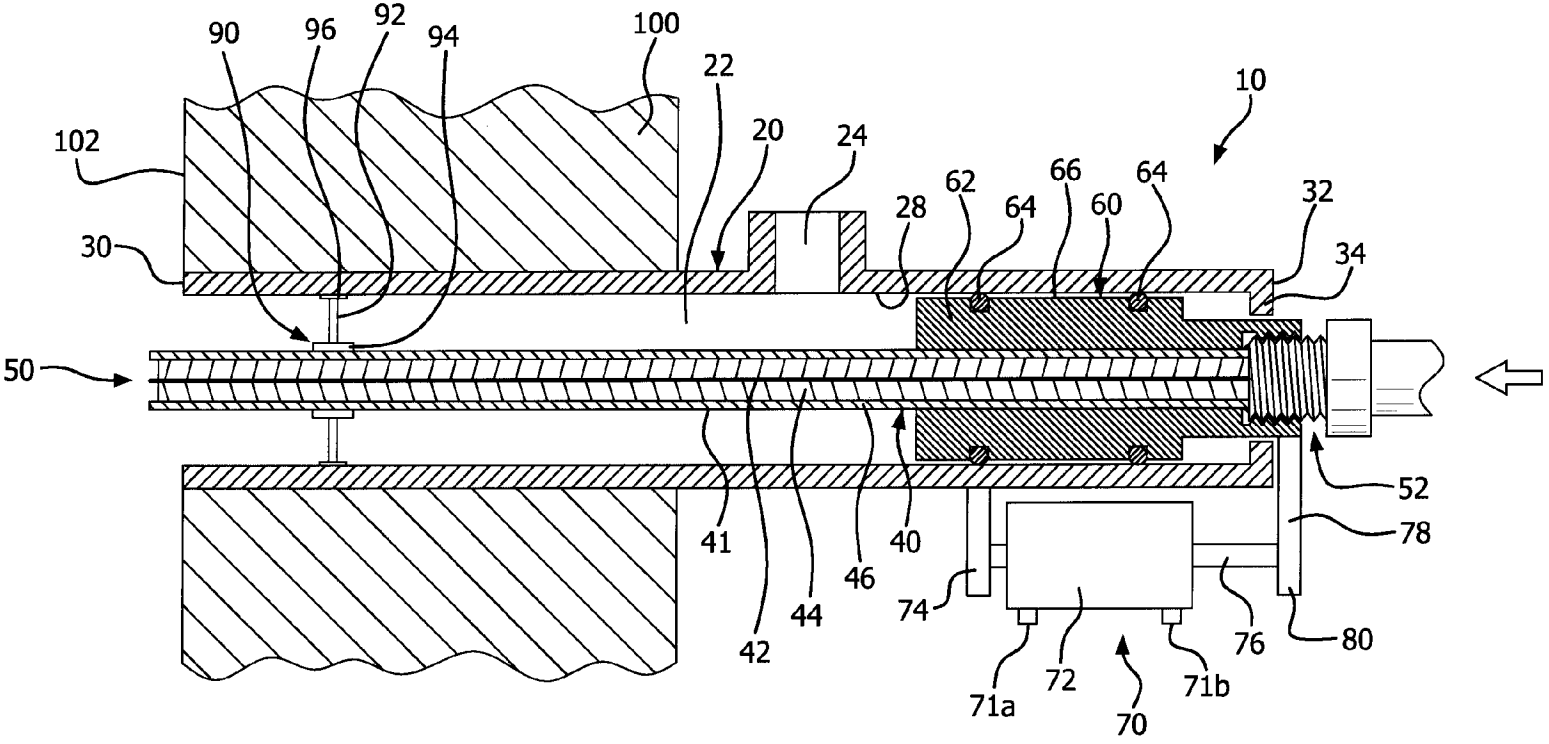
FIG. 1B is a cross-sectional view of an embodiment of a retractable ignition system as in FIG. 1A, wherein the igniter is in an advanced position.

FIGS. 1A and 1B show an embodiment of a retractable burner ignition system 10. The system 10 includes a conduit 20 forming a flow passage 22, and an igniter 40 mounted within the flow passage 22. The flow passage 22 may be a fuel flow passage or an oxidant flow passage. The conduit 20 is mounted within a burner 100 having an outlet face 102. When the burner 100 is installed in a furnace, the outlet face 102 may be adjacent to a combustion zone in the furnace. Alternatively, the outlet face 102 of the burner may be adjacent to a precom buster (not shown) disposed between the burner 100 and the furnace. The ignition system 10 may be used in a burner of any configuration with any number of separate or coaxial fuel and oxidant flow passages. The ignition system 10 may be mounted such that the igniter 40 is in a flow passage of any shape, including but not limited to a circular flow passage, an annular flow passage, and an oblong or substantially rectangular flow passage.

The ignition system may also be used in a burner combusting any type of fuel, including gaseous fuel, liquid fuel, solid fuel, and any combination thereof. As is known in the art, in the case of a liquid fuel, an atomizing nozzle may be provided, and in the case of a solid fuel, pulverized or powdered fuel may be provided with a gaseous carrier fluid. Thus, when the use of fuel gas is discussed herein, it is understood that the igniter system would function equally effectively if the fuel were to include one or more of atomized liquid fuel and pulverized solid fuel in a carrier gas.

The conduit 20 includes an inner surface 28, a front end 30, and a rear end 32 having a radially protruding flange 34. A gas inlet 24 into the flow passage 22 is positioned rearward from the front end 30. Gas, either oxidant or fuel, is provided to the gas inlet 24 and flows through the flow passage 22, and is exhausted out the front end 30 of the flow passage 22. In the depicted embodiment, the front end 30 of the flow passage 22 is substantially coincident with the outlet face 102 of the burner 100, it being understood that substantially coincident includes the front end 30 of the flow passage 22 being slightly recessed or slightly protruding with respect to the outlet face 102 of the burner.

The igniter 40 includes a high voltage electrode 42 that is connected to a source of high voltage electricity, such as that typically provided by an ignition transformer. Ignition transformers, as known in the art, provide a high voltage sufficiently high to jump or spark across an air gap. Commonly, this high voltage is from about 6,000 volts to about 14,000 volts, which is capable of jumping a gap up to about 0.025" to about 0.250". In exemplary igniters, a high voltage of about 7,500 volts was used in combination with a gaps of about 0.090" to about 0.125". A control system 500 for the high voltage electrode 42 is described in more detail below with reference to FIG. 7. The high voltage electrode 42 has a frontward end that defines a tip end 50 of the igniter 40.

The high voltage electrode 42 is surrounded by an insulator 44. The insulator can be any electrically insulating material capable of preventing arcing between the high voltage electrode 42 and the inner surface 28 of the conduit 20, including but not limited to a ceramic material. As is understood in the art, when the available distance between the high voltage electrode 42 and grounded parts of the burner or igniter is sufficiently large (i.e., significantly greater than the gap for arcing to occur), an air gap can serve as an insulator. In the depicted embodiment, a ground electrode 46 surrounds the insulator 44. The igniter 40 is slidably mounted within the flow passage 22 to enable the igniter to be advanced and retracted with respect to the front end 30 of the conduit 20. The igniter 40 may be centrally (e.g., coaxially) positioned within the flow passage 22. Alternatively, the igniter may be positioned closer to one side of the flow passage 22 than another, depending on the desired position of the tip end 50 for ignition of the burner.

The igniter 40 is slidably movable within the flow passage 22 between a retracted position and an advanced position. An exemplary retracted position is shown in FIG. 1A, and an exemplary advanced position is shown in FIG. 1B. In the retracted position, the igniter 40 is positioned so that the tip end 50 is rearward of the combustion zone and substantially protected from overheating due to direct exposure to the extreme temperature conditions occurring with a flame. This helps prevent damage to the igniter 40 from overheating and from deposition of carbon and other particulate matter on the high voltage electrode 42 and the ground electrode 46. In particular, recessing the igniter 40 helps to protect it from coking when positioned in a fuel passage and from oxidation when located in an oxidant passage. In a furnace, such as a furnace used for metal melting, where slag or molten charge may splash back onto the burner 100, the retracted position also helps protect the tip end 50 of the igniter 40 from such splashes.

Depending on the application, the retracted position may position the tip end 50 of the igniter 40 recessed within the conduit 20, or beyond the front end 30 of the conduit 20. A recess distance $D_{RECESS}$ is indicated in FIG. 1A, noting that this distance may be positive (i.e., the tip end 50 recessed from front end 30) or negative (i.e., the tip end 50 extending beyond the front end 30). For purposes of description, burners may be considered to be "low momentum" or "high momentum" depending on the velocity of the gas flowing through the flow passage 22. Although the boundary between the two momentum regimes is somewhat arbitrary, a velocity of about 200 ft/s is used herein, although a different boundary in the range of about 150 ft/s and about 300 ft/s could be used to draw the same distinctions. Moreover, it is understood that flow velocities, and thus corresponding igniter positions, vary on a continuum so that the somewhat arbitrary categorization of burners as "low momentum" and "high momentum" is done herein to solely to illustrate some of the considerations that may be taken into account in positioning the igniter for reliable ignition.

For a low momentum burner, for example a burner in which the gas flowing through the flow passage 22 is flowing at a velocity of less than or equal to about 200 ft/s, the tip end 50 in the retracted position will recessed within the flow passage 22, rearward of the front end 30 by a distance that can be adjusted based on several operating parameters, including but not limited the gas velocities of the fuel and oxidant and the operating temperature and conditions of the furnace. In one embodiment, the recess distance is at least about ½" and in another embodiment is at least about 1".

However, for a high momentum burner, for example a burner in which the gas flowing through the flow passage 22 is flowing at a velocity of greater than about 200 ft/s, such that the flame or combustion zone is lifted from the burner face 102, the tip end 50 in the retracted position may be either recessed within the flow passage 22 or positioned slightly frontward of the front end 30 of the conduit 20. Because of the high momentum of the gas flow and the position of the combustion zone relative to the burner face 102, the igniter 40 can still be protected even if it is not fully retracted within the conduit 20. One advantage of setting the retracted position frontward of the front end 30 of the conduit 20 is to reduce the stroke of actuation of the igniter, i.e., the distance between the retracted and advanced positions. Nevertheless, even for a high momentum burner, it may often be desirable to retract the igniter 40 at least slightly within the conduit 20, to protect the igniter tip end 50 from radiation from the furnace, as well as high levels of radiation, sooting, and oxidation due to proximity to the flame.

In the advanced position, the tip end 50 of the igniter 40 is positioned at or near an interface between fuel and oxidant where a mixture exists that is within the ignition limits for the particular fuel and oxidant enrichment level. In the advanced position, the tip end 50 of the igniter 40 is typically substantially aligned with or frontward of the outlet face 102 of the burner 100. Depending on the type of fuel, the size of the flow passage 22, the type of gas (fuel or oxidant) flowed in the flow passage 22, and the velocity of the fuel and oxidant exiting the burner 100, the position of the tip end 50 of the igniter 40 may be adjusted both axially (i.e., frontward or rearward with respect to the outlet face 102 of the burner 100) and radially (i.e., along or offset from the axis of the flow passage 22). In particular, although the depicted embodiments show the igniter 40 centrally positioned within the flow passage 22, it is understood that the igniter 40 can be positioned offset from the center of the flow passage 22, or even immediately adjacent to a wall of the flow passage 22, to locate the advanced position of the tip end 50 to where desired to achieve reliable ignition of the burner 100. Particularly for high momentum burners, it may be necessary to position the igniter 40 near the wall of the flow passage 22 (offset from the flow passage axis) to limit the distance the igniter tip end 50 must be advanced before reaching the mixing zone.

An actuator 70 is configured to actuate the igniter 40 between the retracted position and the advanced position within the flow passage 22. In the depicted embodiment, the actuator 70 includes an actuator cylinder 72 mounted to the conduit 20 by a fixed support 74. The actuator cylinder 72 drives a plunger 76 that is connected to a rear portion 52 of the igniter 40 by a connecting member 78. The actuator cylinder 72 is preferably pneumatically driven, to avoid the need to provide additional electrical wiring to the burner 100. In one embodiment, the actuator cylinder 72 may include a spring to bias the igniter in the retracted position, and is pneumatically actuated to drive the igniter to the advanced position.

In another embodiment, as depicted, the actuator cylinder 72 is a two-way pneumatic cylinder driven in both directions by pressurized air. As shown, two air inlet connections 71*a* and 71*b* are provided on the pneumatic cylinder 72. As can be understood with reference to the exemplary embodiment of FIGS. 1A, 1B, and 7, when pressurized air is supplied to the air inlet connection 71*b* and the air inlet connection 71*a* is vented, the actuator cylinder 72 actuates the plunger 76 in an advance direction, causing the igniter 40 to advance from the retracted position of FIG. 1A to the advanced position of FIG. 1B. Similarly, when pressurized air is supplied to the air inlet connection 71*a* and the air inlet connection 71*b* is vented, the actuator cylinder 72 actuates the plunger in a retract direction, causing the igniter 40 to retract from the advanced position of FIG. 1B to the retracted position of FIG. 1A.

A manual tab or handle 80 extends outward from the connecting member 78 to enable the igniter 40 to be manually actuated in the event of loss of air pressure for driving the pneumatic cylinder 72.

A two-way or bi-directional pneumatic driven cylinder is preferred over a spring-biased one-way pneumatic drive cylinder because a spring-biased mechanism is less robust in the harsh environments where the ignition system 10 will likely be used, and also because in the event of a loss of pressurized air, a spring-biased mechanism will fail in one position and is more difficult to manually actuate to the other position.

A slidable seal 60 is located between the igniter 40 and the conduit 20. The seal 60 is positioned rearward of the gas inlet 24 of the flow passage 22 and frontward of the rear portion 52 of the igniter 40, so as to provide a seal that prevents gas flowing in the flow passage 22 from leaking out at the rear end 32 of the flow passage 20. In the embodiment depicted in FIGS. 1A and 1B, the seal 60 includes a seal block 62 sealed against and affixed to an outer surface 41 of the igniter 40, and a pair of seal members 64 seated in an outer wall 66 of the seal block 62. The seal members 64 seal against the inner surface 28 of the conduit 20. The seal 60, including the seal block 62 and the seal members 64 travels with the igniter 40 between the retracted and advanced positions, and continually provides a seal against the inner surface 28 of the conduit 20. The seal members 64 are made from a material that is compatible with the gas flowing in the flow passage 22. The seal members 64 may be o-rings. In addition, it is understood that although two seal members 64 in series are shown, the seal 60 can also be constructed to have one seal member 64 or three or more seal members 64 in series.

Figure 2:
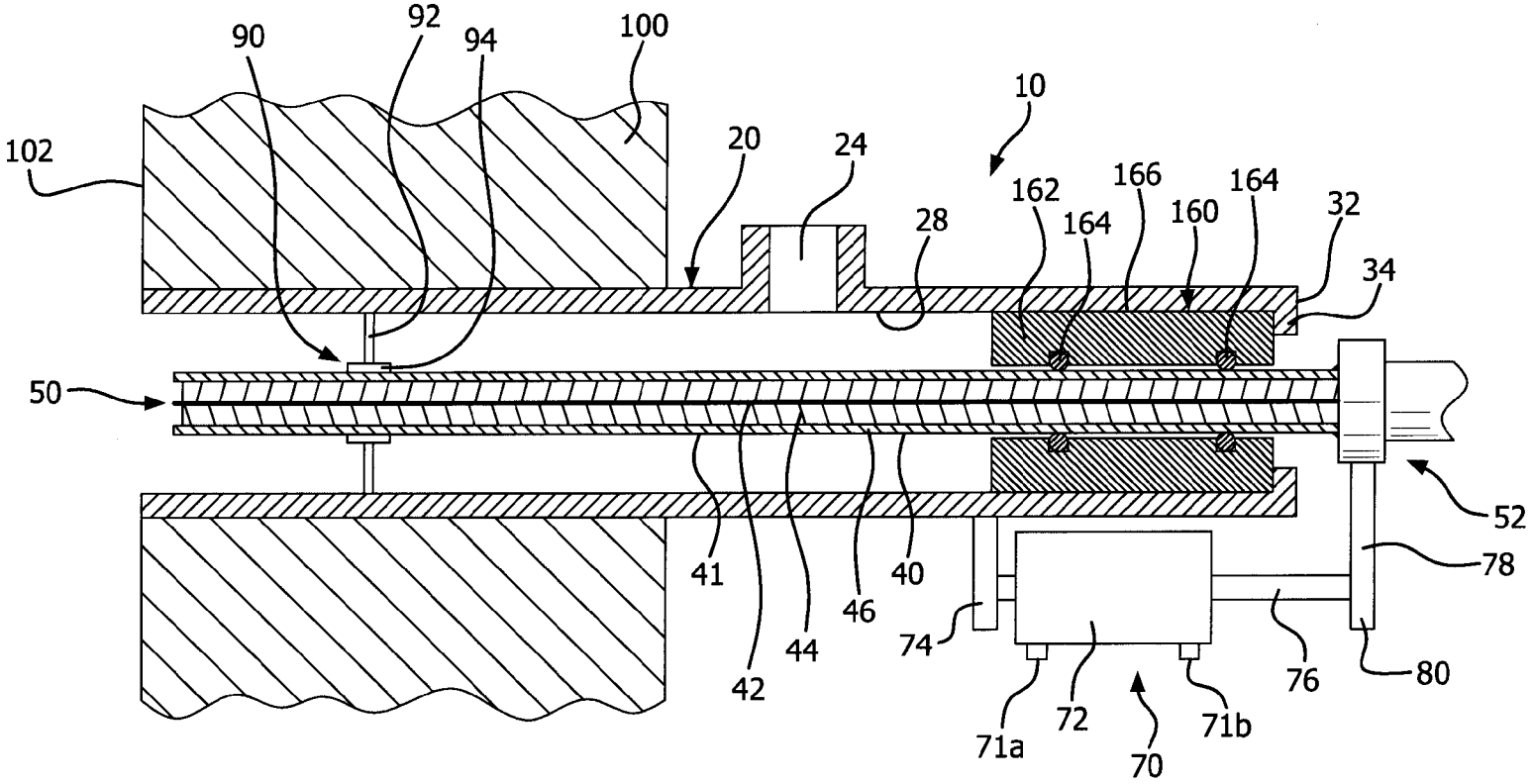
FIG. 2 is a cross-sectional view showing another embodiment of a retractable ignition system.

In an alternate embodiment, as shown in FIG. 2, a seal 160 includes a seal block 162 sealed against and affixed to the inner surface 28 of the conduit, and a pair of seal members 164 seated in an inner wall 166 of the seal block 162 and sealing against the outer surface 41 of the igniter 40.

Particularly in harsh and dusty environments, the actuator 70 and the rear portion 52 of the igniter 40, including the seal 60, is preferably housed in a sealed enclosure to protect the moving components of the actuator 70 and seal 60 from dust and particulates.

Figure 3:
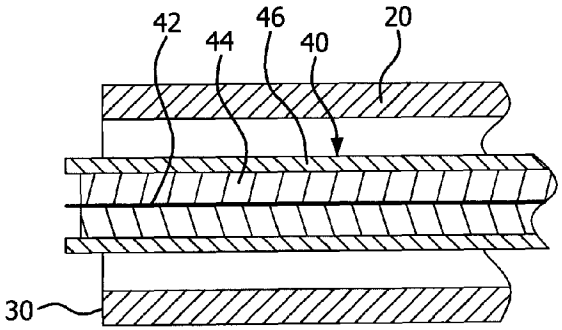
FIG. 3 is an expanded view of a tip portion of an embodiment of a retractable ignition system in which the igniter includes high voltage and ground electrodes.

Several embodiments of an igniter may be constructed as functional equivalents, and front portions of four exemplary igniters are shown in FIGS. 3-6. FIG. 3 shows an igniter 40 as in FIGS. 1 A and 1 B, in which the high voltage electrode 42 and the insulator 44 are surrounded by a ground electrode 46. The ground electrode 46 may completely surround the insulator 44. Alternatively, the ground electrode 46 may extend only partway around the insulator 44. The ground electrode 46 is connected to an electrical ground (not shown). In the depicted embodiment, the high voltage electrode 42 and the ground electrode 46 protrude beyond the insulator 44 by a distance $D_{TIP}$ such that a sufficient amount of the electrodes 42 and 46 are exposed to each other to allow arcing or sparking when high voltage is supplied to the high voltage electrode 42. $D_{TIP}$ is preferably at least 1/32" and less than about 1/4", and may be about 1/16".

Figure 4:
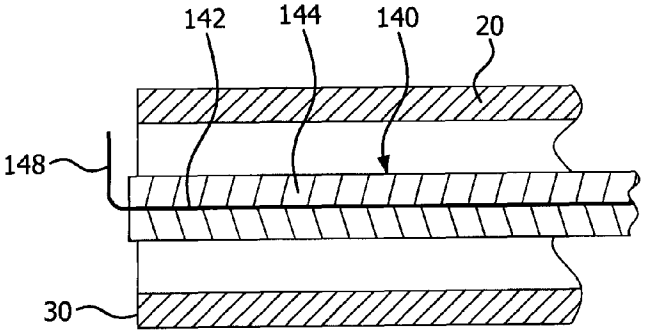
FIG. 4 is an expanded view of a tip portion of an embodiment of a retractable ignition system in which the igniter includes a high voltage electrode and an end of a flow passage serves as a ground electrode.

FIG. 4 shows an igniter 140 in which the high voltage electrode 142 and the insulator 144 are not surrounded by a ground electrode, but instead the front end 30 of the conduit 20 itself serves as a ground electrode. In this embodiment, the high voltage electrode 142 may include an extended tip 148 that protrudes radially outward toward the front end 30 of the conduit 20 to create an appropriate gap for arcing during ignition.

Figure 6:
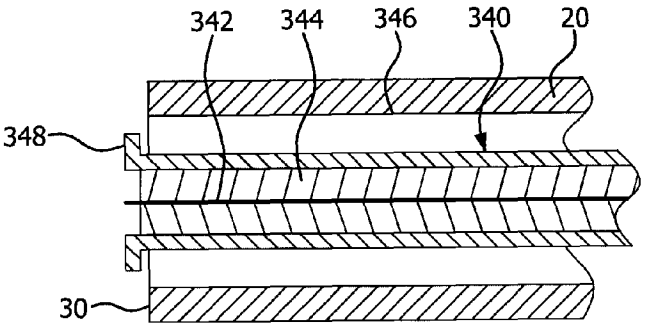
FIG. 6 is an expanded view of a tip portion of an embodiment of a retractable ignition system in which the igniter includes a flared tip.
Figure 5:
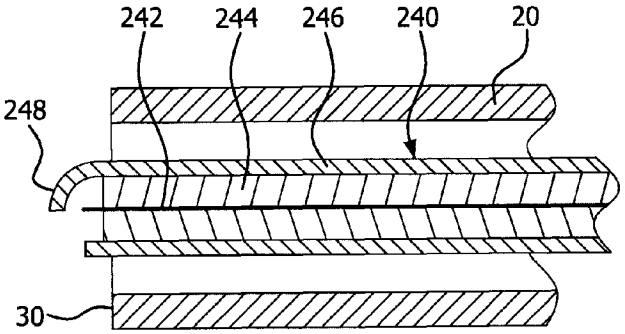
FIG. 5 is an expanded view of a tip portion of an embodiment of a retractable ignition system in which the igniter includes a cupped tip.

FIGS. 5 and 6 show igniters than may be particularly useful in igniting high momentum burners. FIG. 5 shows an igniter 240 having a high voltage electrode 242 surrounded by an insulator 244, both of which are at least partially surrounded by a ground electrode 246. A cupped member 248 extends frontward and radially inward from the ground electrode 246 to create an appropriate gap for arcing between the cupped member 248 and the high voltage electrode 242. The cupped member 248 may be integral with the ground electrode 246 or affixed to the ground electrode 246. The cupped member 248 serves to disrupt the momentum of gas flowing past the tip end 50 of the igniter 40 and create a pocket of recirculation or low velocity gas that is more easily ignitable.

FIG. 6 shows an igniter 340 having a high voltage electrode 342 surrounded by an insulator 344, both of which are at least partially surrounded by a ground electrode 346. A lip or flange 248 protrudes radially outward from the ground electrode 346. The lip 248 extends into and disrupts the gas flow exiting the flow passage 22, thereby creating a recirculation zone at the tip end 50 of the igniter 40 that enhances mixing of fuel and oxidant and creates a lower velocity ignitable mixture in close proximity to the tip end 50.

To position the igniter 40 in a desired location relative to the conduit 20, a guide member 90 may be provided, as shown in FIGS. 1A, 1B, and 2. In some embodiments, the igniter 40 may be substantially centered within the flow passage 22. In other embodiments, the igniter 40 may be offset to a position closer to one wall of the flow passage 22 than another, so that in the advanced position the tip end 50 of the igniter 40 will be located in a mixing zone between fuel and oxidizer.

In the depicted embodiment, the guide member 90 has a hub 94 secured to the outer surface 41 of the igniter 40 and a plurality of spokes 92 extending radially outward from the hub 94 and contacting the inner surface 28 of the conduit 20. The guide member 90 moves along with the igniter 40 between the retracted and advanced positions. Pads 96, made from a low friction material such as PTFE, may be mounted on radially outer ends of the spokes 92 to inhibit marring of the inner surface 28 of the conduit 20. The number of spokes 92 is preferably minimized so as to limit the amount of flow disruption caused by the guide member 90, it being understood that at least two spokes 92 are necessary to position the igniter 40 and that three or more spokes 92 may be preferred to provide stable support for the igniter 40.

In an alternate embodiment (not shown), the guide member 90 may include a plurality of spokes affixed to and extending radially inward from the inner surface 28 of the conduit 20 and pads to facilitate sliding of the spokes along the outer surface 41 of the igniter 40. In this embodiment, the guide member 90 remains stationary with the conduit 20 while the igniter 40 moves with respect to the guide member 90 between the retracted and advanced positions.

Figure 7:
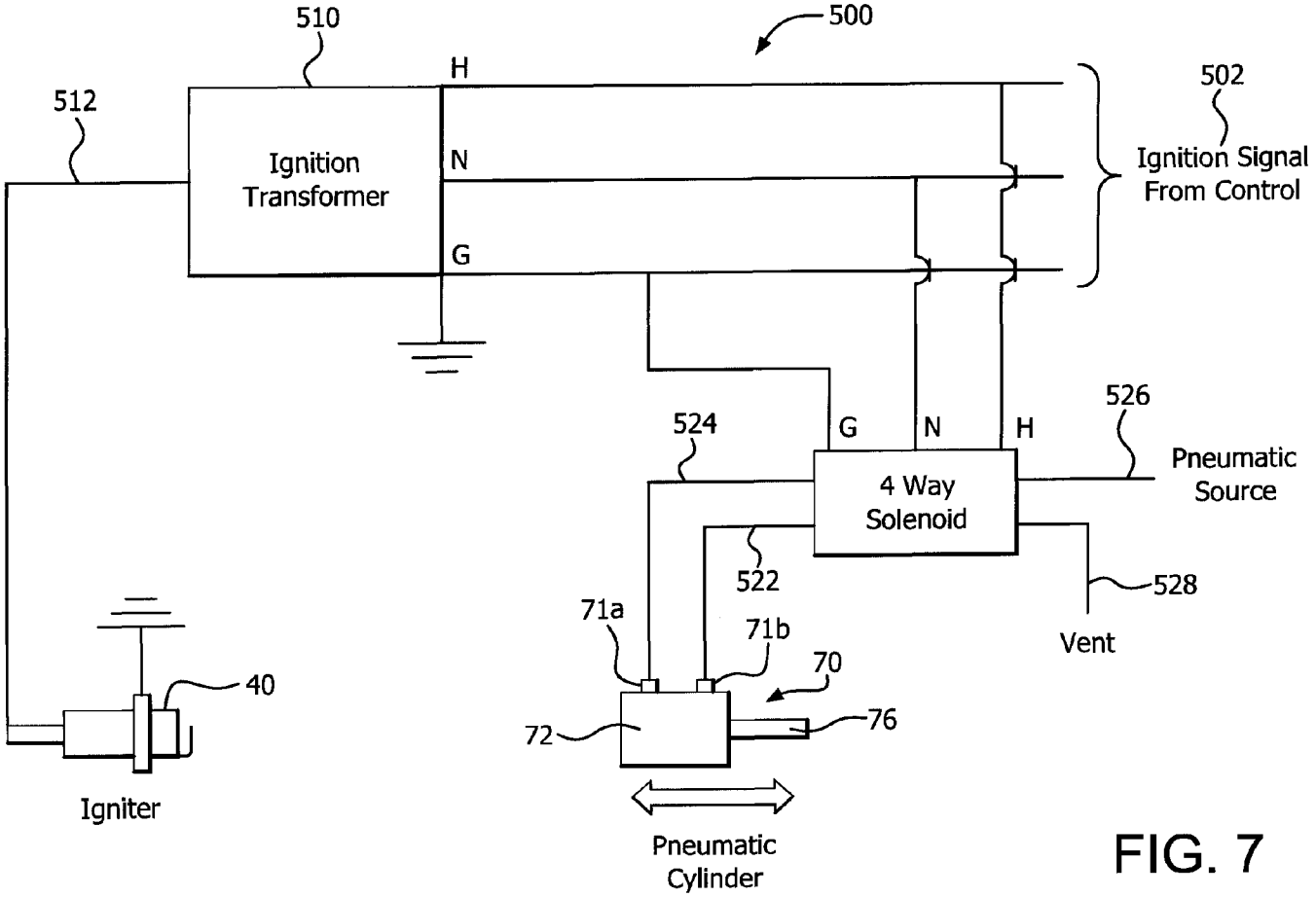
FIG. 7 is a schematic of an exemplary control system for an ignition system.

An exemplary control system 500 for an ignition system 10 is shown in FIG. 7. A controller (not shown) provides an ignition control signal 502 when the burner 100 is to be ignited. The ignition control signal 502 is routed to an ignition transformer 510 and to a four-way solenoid valve 520. The four-way solenoid valve 520 has a pneumatic source input 526, a first pneumatic output 522 connected to the air inlet connection 71*a* on the pneumatic cylinder 72, a second pneumatic output 524 connected to the air inlet connection 71*b* on the pneumatic cylinder 72, and a vent 528. The valve 520 has two positions and is configured such that when the valve 520 is in a first position, the first output 522 is connected to the source input 526 and the second output 524 is connected to the vent 528, and when the valve 520 is in a second position, the first output 522 is connected to the vent 528 and the second output 524 is connected to the source input 526.

In the absence of the ignition control signal 502, the ignition transformer 510 is not energized and no high voltage signal is sent to the igniter 40. In addition, the four-way solenoid valve 520 is de-energized in the first position such that the pneumatic source input 526 is connected to the air inlet connection 71*a* on the pneumatic cylinder 72 via the second output 524 while the air inlet connection 71*b* is connected to the vent 528 via the first output 522, causing the igniter 40 to be in the retracted position.

Upon receipt of the ignition control signal 502, the ignition transformer 510 is energized and transmits a high voltage signal 512 to the high voltage electrode 42 of the igniter 40, causing the igniter 40 to arc or create sparks that can be used to ignite the burner 100. Substantially simultaneously, upon receipt of the ignition control signal 502, the four-way solenoid valve 520 is energized to the second position such that the pneumatic source input 526 is connected to the air inlet connection 71*b* on the pneumatic cylinder 72 via the first output 522 while the air inlet connection 71*a* is connected to the vent 528 via the second output 522, causing the igniter 40 to move to the advanced position. As long as the ignition control signal 502 is provided, the ignition transformer 510 continues to transmit a high voltage signal 512 to the igniter and the igniter is retained in the advanced position by the pneumatic cylinder 72.

When a retraction condition is met, the ignition control signal 502 ceases. Upon cessation of the ignition control signal 502, the ignition transformer 510 is de-energized and the igniter 40 stops arcing. Substantially simultaneously, the four-way solenoid valve 520 is de-energized, causing the igniter 40 to move to the retracted position. The retraction condition may be the expiration of an ignition timer, the detection of ignition by a flame sensor, or any other condition to indicate that the igniter 40 should be deactivated.

The control system 500 may also include a fuel solenoid valve (not shown) in a fuel conduit supplying fuel to the burner 100. The fuel solenoid valve may supply fuel to the flow passage 22 housing the igniter 40 or to another flow passage in the burner 100. Upon receipt of the ignition control signal 502, the fuel solenoid valve opens to enable fuel flow. In one embodiment, the fuel solenoid valve supplies fuel to a fuel passage that will continue to receive fuel once the burner 100 is ignited, and thus the fuel solenoid remains open even when the igniter 40 is retracted and sparking has been stopped. In another embodiment, the fuel solenoid valve supplies fuel to a fuel pilot, and thus the fuel solenoid closes upon cessation of the ignition control signal 502. The fuel pilot may be a separate dedicated flow passage in the burner 100. In one embodiment, the fuel pilot is provided along with oxidant in the flow passage 22, and fuel flow is stopped upon cessation of the ignition control signal 502.

In another embodiment, the control system 500 may also include an oxidant solenoid valve (not shown) in an oxidant conduit supplying oxidant to the burner 100. The oxidant solenoid valve may supply oxidant to the flow passage 22 housing the igniter 40 or to another flow passage in the burner 100. Upon receipt of the ignition control signal 502, the oxidant solenoid valve opens to enable fuel flow. In one embodiment, the oxidant solenoid valve supplies oxidant to an oxidant passage that will continue to receive oxidant once the burner 100 is ignited, and thus the oxidant solenoid remains open even when the igniter 40 is retracted and sparking has been stopped. In another embodiment, the oxidant solenoid valve supplies oxidant to an oxidant conduit that is used only for ignition, and thus the oxidant solenoid closes upon cessation of the ignition control signal 502.

The present invention is not to be limited in scope by the specific aspects or embodiments disclosed in the examples which are intended as illustrations of a few aspects of the invention and any embodiments that are functionally equivalent are within the scope of this invention. Various modifications of the invention in addition to those shown and described herein will become apparent to those skilled in the art and are intended to fall within the scope of the appended claims.

The invention claimed is:

1. An integrated retractable burner ignition system, comprising:

a burner having an outlet face and a flow passage including a front end substantially coincident with the outlet face of the burner and a gas inlet positioned rearward from the front end of the flow passage;

an igniter including a high voltage electrode surrounded by an insulator and extending beyond the insulator to form a tip end of the igniter, the igniter being mounted slidably within the flow passage;

an actuator connected to a rear portion of the igniter and configured to advance and retract the igniter within the flow passage;

a slidable seal between the igniter and the flow passage, the seal being positioned rearward of the gas inlet of the flow passage and frontward of the rear portion of the igniter; and a high voltage transformer configured to provide high voltage to the high voltage electrode upon receipt of a control signal;

wherein the actuator is configured to advance the igniter upon receipt of the control signal and to retract the igniter upon cessation of the control signal.

2. The system of claim 1, wherein the actuator is a bi-directional pneumatic actuator configured to pneumatically advance and pneumatically retract the igniter.

3. The system of claim 2, wherein the pneumatic actuator includes a handle connected to the rear portion of the igniter to enable the igniter to be manually advanced and retracted in the absence of a supply of pressurized air.

4. The system of claim 1, wherein the seal includes a seal block mounted to an outer surface of the igniter and slidably sealing along an inner surface of the flow passage.

5. The system of claim 1, wherein the seal block includes a seal mounted to an inner surface of the flow passage and slidably sealing along an outer surface of the igniter.

6. The system of claim 1, wherein the flow passage is grounded such that when the igniter is advanced, a gap is created between the high voltage electrode and the front end of the flow passage across which arcing can occur.

7. The system of claim 1, the igniter further comprising a ground electrode at least partially surrounding the insulator, such that a gap is formed between the high voltage electrode and the ground electrode across which arcing can occur.

8. The system of claim 1, further comprising a guide member located between an outer surface of the igniter and in inner surface of the flow passage, and between the flow passage gas inlet and front face, for positioning the igniter within the flow passage.

9. The system of claim 8, wherein the guide member is affixed to the igniter to advance and retract with the igniter.

10. The system of claim 8, wherein the guide member is affixed to the flow passage to remain stationary when the igniter is advanced and retracted.

11. The system of claim 1, wherein the actuator is configured to retract the igniter to a retracted position in which the tip end of the igniter is recessed within the flow passage.

12. The system of claim 1, wherein the actuator is configured to retract the igniter to a retracted position in which the tip end of the igniter is extended frontward beyond the front end of the flow passage.

13. The system of claim 1, wherein the flow passage is a fuel passage.

14. The system of claim 1, wherein the flow passage is an oxidant passage.

15. The system of claim 1, further comprising a fuel solenoid valve in a fuel conduit supplying fuel to the burner, the fuel solenoid valve being configured to open to enable fuel flow upon receipt of the control signal.

16. The system of claim 15, wherein flow passage is an oxidant passage, wherein the fuel conduit is configured to provide fuel flow to the flow passage, and wherein the fuel solenoid is further configured to close to disable fuel flow upon cessation of the control signal.

17. The system of claim 15, further comprising an oxidant solenoid valve in an oxidant conduit supplying oxidant to the burner, the oxidant solenoid valve being configured to open to enable oxidant flow upon receipt of the control signal.

18. The system of claim 1, wherein the actuator is configured to retract the igniter when a flame detector detects the presence of a flame frontward of the outlet face of the burner.

19. A retractable ignition system for mounting in a flow passage of a burner having an outlet end, comprising:

an igniter including a high voltage electrode surrounded by an insulator and extending beyond the insulator to form a tip end of the igniter, the igniter being mounted slidably within the flow passage of the burner, the igniter comprising a ground electrode at least partially surrounding the insulator;

an actuator connected to a rear portion of the igniter and configured to pneumatically advance and pneumatically retract the igniter with respect to the outlet end; and a slidable seal between the igniter and the flow passage, the seal being positioned rearward of a gas inlet into the flow passage and frontward of the rear portion of the igniter.

20. The retractable ignition system of claim 19, wherein the ground electrode extends beyond the insulator.

21. The retractable ignition system of claim 19, wherein the ground electrode includes a cupped member extending radially inward from an edge of the ground electrode toward the high voltage electrode.

22. The retractable ignition system of claim 19, wherein the ground electrode includes a radially outwardly protruding lip.

23. A method of igniting a burner having an outlet face and a flow passage, comprising:

advancing an igniter located within the flow passage to an advanced position in which a tip end of the igniter is aligned with or frontward of the outlet face of the burner, the igniter including a high voltage electrode surrounded by an insulator and extending beyond the insulator to form the tip end;

supplying high voltage to the high voltage electrode while the igniter is in the advanced position; and retracting the igniter in a rearward direction from the advanced position to a retracted position when a retraction condition is met;

wherein the igniter is not biased toward either the advanced position or the retracted position; and wherein the retraction condition is one of expiration of a timer and detection of a flame frontward of the outlet face of the burner.

24. The method of claim 23, further comprising:

initiating high voltage to the high voltage electrode substantially simultaneously with the step of advancing the igniter.

25. The method of claim 24, further comprising:

ceasing high voltage to the high voltage electrode substantially simultaneously with the step of retracting the igniter.

26. The method of claim 23, further comprising:

flowing gas at high momentum through the flow passage;

wherein in the retracted position, the tip end of the igniter is frontward of the outlet face of the burner.

27. The method of claim 23, further comprising:

flowing gas at low momentum through the flow passage;

wherein in the retracted position, the tip end of the igniter is within the flow passage.

* * * * *